US007232238B2

(12) United States Patent
Long et al.

(10) Patent No.: US 7,232,238 B2
(45) Date of Patent: Jun. 19, 2007

(54) RENEWABLE ENERGY FLASHLIGHT

(75) Inventors: Jon Darin Long, Ogden, UT (US); Qian Tianming, Ningbo (CN)

(73) Assignee: RSGA International, Inc., Ogden, UT (US)

( * ) Notice: Subject to any disclaimer, the term of this patent is extended or adjusted under 35 U.S.C. 154(b) by 26 days.

(21) Appl. No.: 11/199,021

(22) Filed: Aug. 8, 2005

(65) Prior Publication Data

US 2007/0030671 A1 Feb. 8, 2007

(51) Int. Cl.
*F21L 13/06* (2006.01)

(52) U.S. Cl. ..... 362/192; 362/157

(58) Field of Classification Search ..... 362/192, 362/157

See application file for complete search history.

(56) References Cited

U.S. PATENT DOCUMENTS

| | | | | |
|---|---|---|---|---|
| 3,099,402 | A | 7/1963 | Speck | |
| 3,345,507 | A | 10/1967 | Messinger et al. | |
| 4,333,129 | A * | 6/1982 | Ewing | 362/205 |
| 4,360,860 | A | 11/1982 | Johnson et al. | |
| 5,552,973 | A | 9/1996 | Hsu | |
| 5,904,414 | A | 5/1999 | Monteleone et al. | |
| 5,975,714 | A | 11/1999 | Vetorino et al. | |
| 6,220,719 | B1 * | 4/2001 | Vetorino et al. | 362/192 |
| 6,322,233 | B1 | 11/2001 | Brandt | |
| 6,729,744 | B2 | 5/2004 | Mah | |
| 6,808,288 | B2 | 10/2004 | Mah | |
| 6,893,141 | B2 | 5/2005 | Mah | |
| 2002/0030994 | A1 | 3/2002 | Krietzman et al. | |
| 2004/0062039 | A1 | 4/2004 | Ahn | |

* cited by examiner

*Primary Examiner*—Sandra O'Shea
*Assistant Examiner*—James W Cranson, Jr.
(74) *Attorney, Agent, or Firm*—Fish & Richardson P.C.

(57) ABSTRACT

A renewable energy flashlight employing a pair of elasto-magnetic repulsion members to assist in reciprocating a charging magnet passing through surrounding induction coils to enhance the efficiency of manually charging a capacitor to power an LED lens amplified flashlight.

9 Claims, 6 Drawing Sheets

RENEWABLE ENERGY FLASHLIGHT

BACKGROUND OF THE INVENTION

1. Field of Invention

The present invention relates to renewable energy flashlights. In particular, it relates to a renewable energy flashlight employing a pair of elastomagnetic repulsion members to assist in reciprocating a charging magnet passing through surrounding induction coils to enhance the efficiency of manually charging a capacitor to power a light emitting diode lens amplified flashlight.

2. Description of Related Art

Various renewable flashlights are known. Vetorino, U.S. Pat. No. 6,220,719 discloses a renewable energy flashlight employing a reciprocating charging magnet traversing a travel chamber enwrapped with induction coils to generate a current, when manually shaken. The ends of the travel chamber have reverse polarity magnets to that of the charging magnet, which directly contact and repel the charging magnet to aid in reciprocating the charging magnet. These Vetorino '719 repeated magnet-to-magnet contacts jar the reciprocating components of the renewable energy flashlight and result in loss of rebound energy and rapid wear of the parts.

Vetorino, U.S. Pat. No. 5,975,714 discloses another renewable energy flashlight employing a reciprocating charging magnet traversing a travel chamber enwrapped with induction coils to generate a current, when manually shaken. Vetorino '714 employs rebound springs at the ends of the travel chamber, which are contacted and compressed by the charging magnet until they uncoil and reverse the travel of the charging magnet to aid in reciprocating the charging magnet. The Vetorino '719 springs suffer from spring fatigue over time, or spring deformation if shaken too hard.

Mah, U.S. Pat. No. 6,808,288 discloses a Faraday Flashlight similar to Vetorino, but claims 1–16 omits the Vetorino '719 reverse polarity magnets or Vetorino '714 rebound springs. The Mah '288 claims 1–16 embodiment without dual dampers to assist in reciprocating the charging magnet travels slower within the travel chamber and therefore does not charge as fast as the recoil assist embodiment. The Mah '288 claims 17–22 embodiment employs dual dampers at each end of the travel chamber to dampen the impact resulting from the translating movement of the charging magnet. The Mah '288 claims 17–22 dual damper embodiment therefore travels even slower than the claims 1–16 embodiment having no reciprocating means.

Mah, U.S. Pat. No. 6,729,744 discloses a Faraday Flashlight similar to the Vetorino embodiments, but it employs dual spring bumpers located inside or outside the flashlight at each end of the tubular chamber to reciprocate the charging magnet. The Mah '714 dual spring bumpers also suffer from spring deformation and declining rebound performance caused by spring fatigue. This spring fatigue in the Mah '714 dual spring bumpers can occur very rapidly. If shaken too hard, the spring(s) become misshapen causing the rubber bumper to rub against the side of the internal tube or not return the charging magnet in a directly lateral direction. When this happens, the affected bumper is rendered virtually useless. It is all muscle activity from there and some of the same reciprocating jarring affects the Vetorino model begin to affect the other internal components. This lack of reflexive properties causes a heavy thump at each end of the tube, when shaken.

Mah, U.S. Pat. No. 6,893,141 discloses a Faraday Flashlight similar to the Vetorino embodiments, but it employs dual spring bumpers similar to Mah '714 located at each end of the tubular chamber to reciprocate the charging magnet to charge a circuit, which includes an additional supplemental charging system employing a battery and incandescent light. As such, it suffers from all of the Mah '714 spring fatigue and spring distortion charging problems.

Speck U.S. Pat. No. 3,099,402 discloses a lever powered generator driving flashlight using storage batteries, but does not disclose the mechanism of your invention. W. Messinger, U.S. Pat. No. 3,345,507 discloses a dynamo operated pocket flashlight activated by squeezing. Johnson et al, U.S. Pat. No. 4,360,860 has expired and discloses a crank operated generator lantern. Hsu, U.S. Pat. No. 5,552,973 discloses a generator power flashlight operated by a pull string, which has a backup storage battery system. Ahn, Pub. No. US2004/0062039 published Apr. 1, 2004 discloses a portable electronic signal light with a power self generator operated by the squeezing of a lever handle.

Other patents of general interest are: Brandt, U.S. Pat. No. 6,322,233 disclosing an emergency flashlight with a rotating handle associated to operate a generator upon rotation of the handle. Kreitzman et al, U.S. Pub 2002/0030994 published Mar. 14, 2002 discloses a fuel cell powered portable light. Monteleone et al, U.S. Pat. No. 5,904,414 discloses a flashlight with a gas permeable membrane and battery polarization.

The present invention described below provides a renewable energy flashlight employing a pair of elastomagnetic repulsion members to assist in reciprocating a charging magnet passing through surrounding induction coils to enhance the efficiency of manually charging a capacitor to power an LED lens amplified flashlight.

SUMMARY OF THE INVENTION

The present invention comprises a renewable energy flashlight having a main housing with an opening at one end leading into an interior chamber and a closed end. The interior chamber accommodates a cylindrical tubular carriage sized to fit and be inserted within the main housing interior chamber. The tubular carriage defines an internal transverse chamber with a first end, and a second end into which a reciprocating charging magnet is mounted.

Support structure is associated with the main housing and/or tubular carriage for holding electrical components such as switches, capacitors, and the light emitting diodes proximate the opening of the main housing after the tubular carriage is inserted therein. In one preferred embodiment the end of the tubular carriage proximate the housing opening has its end formed with an open box frame for holding mounted light circuitry on a circuit board.

A charging magnet having a magnetic field is mounted within the internal transverse chamber, which is structured to hold the charging magnet for lateral transversing movement between its first and second ends. The transverse chamber is wrapped with at least one induction coil and the size of the magnet is matched to the length and depth of the copper coil for maximum inductive current creation.

A pair of elastomagnetic rebound members is then opposedly mounted with one at each of the two ends of the transverse chamber. Each rebound member is comprised of an elastic rebounding material such as rubber or silicone into which is reflexively seeded at least one internal magnet.

These rebound members are opposedly mounted in polar opposition to the charging magnet to elastically and magnetically assist in rebounding there between the charging magnet. Each of the elastomagnetic repulsion members is void of any moving parts. They employ natural reverse polarity to reduce waste in human exertion required to shake the charging magnet to power the light emitting diode. All that is needed is a simple horizontal rolling motion of the wrist. Because of the increase in the rebounding speed of the charging magnet, recharging efficiency is increased by as much as 70% thereby reducing charge time. These rebound members simultaneously eliminate the vibration stress damage on electronic components and allow the charging magnet to pass completely through the copper coil for a complete inductive cycle. As they do not employ conventional springs, they are lighter and easier to handle and not subject to spring fatigue.

This design facilitates the manual horizontal movement of the flashlight so that the magnet slides through the copper coil, and creates a natural enhanced repulsion at each end of the transfer tube to take advantage of the momentum of the magnet upon passing through the copper coil and propel its return trip to the opposite end of the transfer tube. Light emitting diode power consumption is less than that generated by gentle shaking with minimal wrist energy. The result is an efficient sealed mechanical system, which can be continuously operated with minimal human energy expense and maximum device power generation and management.

At least one induction coil is wrapped around the tubular carriage such that the charging magnet may pass completely through the induction coil during each transverse pass to induce current through the induction coil. For more rapid charging, two or more coils are employed and spaced apart sufficient for the charging magnet to sequentially pass there through to generate additional higher frequency added current from each transverse pass.

A capacitor is operably associated with the induction coil for storage of the electric current generated by the induction coil and is generally mounted on the support platform along with a light emitting diode.

Circuitry is mounted on the support structure and connected to the capacitor, the light emitting diode and the induction coil to selectively charge the capacitor in one mode and discharge the capacitor to power the diode in the other mode. After the tubular carriage and electronic components are placed with the housing, a convex magnifying lens covering and sealing the opening of the housing.

For renewable flashlight embodiments used around electronic devices, the renewable energy flashlight preferably employs magnetic shielding. Magnetic shielding may be facilitated by any or all of the following:

a. Material within plastic of the housing or carriage such forming them out of high shielding efficiency (SE) doped polyaniline, polypyrrole, and polyacetylene.
b. Paint or a sprayed on material applied to the inner or outer surface of the housing or outside of the carriage, such as coating them with a paint having copper particles contained therein such as the water based paint sold under the trade name CuPro-Code™ or StaticVeil™, or the nickel-rich paint that is manufactured by Acheson Colloids.
c. A film material added to either the inside the housing or encasing the tubular carriage, such as an encasement made of Mumetal, which is an alloy of 5% Copper, 2% Chromium, 77% Nickel, and 16% Iron.

The shielding selected is dependent upon the strength of the magnets and the geometry of the components and circuitry. Coatings using polymeric magnets have the added advantage of providing decorative accents. The inherent low densities and high molecular masses of molecule/polymer-based magnets mean that bulk applications relying on high magnetic moments either on a mass or volume basis are unlikely.

The renewable energy flashlight preferably includes a concave reflective mirror surrounding the light emitting diode structured to capture and direct light through the lens to enhance the light beam. This reduces significantly the lost light through the head of the housing.

For renewable energy flashlight embodiments used around water, the components are sealed within the housing forming a water impervious flashlight. Preferably, these embodiments have a density less than water so that they can float. To maintain the vapor seal, the circuitry includes a sealed reed switch mounted to the exterior of the housing to turn the light emitting diode on and off via a reciprocating magnet.

The present invention is therefore particularly adapted to provide a faster charging, brighter, renewable energy flashlight particularly suited for use near water and electrical components.

DESCRIPTION OF THE ILLUSTRATED EMBODIMENTS

Figure 1:
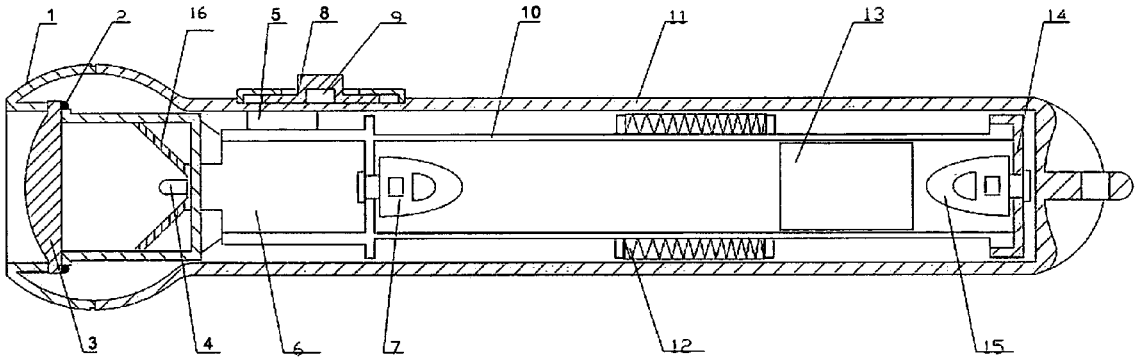
FIG. 1 is a side cross sectional view of one preferred embodiment of the invention.

One preferred embodiment of the renewable energy flashlight is shown in the FIG. 1 side cross section. The components shown are as follows:

1. Bezel
2. Seal
3. Beam magnifying lens
4. Light Emitting Diode (LED)
5. Sealed ferrous reed switch
6. Circuit board with capacitor
7. Seed Magnet
8. Sliding plastic switch shield
9. Switch Magnet
10. Inner tubular carriage
11. Polycarbonate outer shell housing
12. Copper induction coil
13. Charging magnet
14. Tube sealing base cap
15. Elastomagnetic rebound member
16. Reflecting bowl mirror Sealed within the renewable polycarbonate outer shell housing 11 is an inner tubular carriage 10 into which is slideably mounted a charging magnet 13. The tubular carriage 10 is surrounded by a copper coil 12, such that as the charging magnet 13 reciprocates there through an electrical current is generated, which is collected on the circuit board capacitor 6.

A pair of opposedly mounted elastomagnetic rebound members 15 is mounted on either end of the tubular carriage 10 to assist in recoiling the charging magnet 13 there between. A first elastomagnetic rebound member 15 is mounted through an end cap located inside and at said first end of the cylindrical inner tubular carriage 10 and a second elastomagnetic rebound member 15 is located inside and at said second end of said cylindrical inner tubular carriage 10. The elastomagnetic rebound member 15 is constructed of a resilient silicone material resistent to ultraviolate light for use with transparent housings 11. The rebound member 15 is embedded with at least one seed magnet 7 and sized to fit within the cylindrical inner tubular carriage 10 without contacting its walls when compressed to avoid wall interference with its recoil action. The elastomagnetic rebound member 15 shown has an air pocket cushion sealed therein just in front of the seed magnet 7. The elastomagnetic rebound members 15 are mounted such that their seed magnets are in polar opposition for natural reduction and repulsion of the charging magnet 13 as it transverses and rebounds within the cylindrical inner tubular carriage 10, which is surrounded by a single copper coil 12. The rebound silicone material of the elastomagnetic rebound members 15 is first compressed until the charging magnet is slowed and stopped in the proximity of the seeded magnet. The charging magnet 13 direction is then reversed and rebounded elastically and magnetically so that the charging magnet 13 recoils between the elastomagnetic repulsion members 15 with minimal energy loss.

The particular single coil embodiment shown in FIG. 1 has a bezel 1 with a seal 2 to secure a magnifying lens 3 over the opening in the housing 11, thereby making it impervious to water. As it only employs one coil 12 and no magnetic shielding, this embodiment has a density less than water and floats. A sealed ferrous reed switch 5 is housed within the housing 11 and is mounted upon the circuit board 6. A sliding plastic shield 8 holding a magnet 9 is mounted above said switch 5, outside the housing 11 to allow the flow of inductive current stored in the form of electric energy within said capacitor 6 and opened by moving said magnet from proximity to said switch releasing said electrical charge stored in said capacitor 6 through said circuitry to power the light emitting diode 4. This switch 5 is included to shut down the flow of electricity to the light emitting diode 4 during charging to more rapidly charge the capacitor.

A cone shaped light-reflecting bowl 16 with a central hole mounted around and behind said light emitting diode 4 is included to capture and amplify light directed through the magnifying lens 3.

Figure 2:
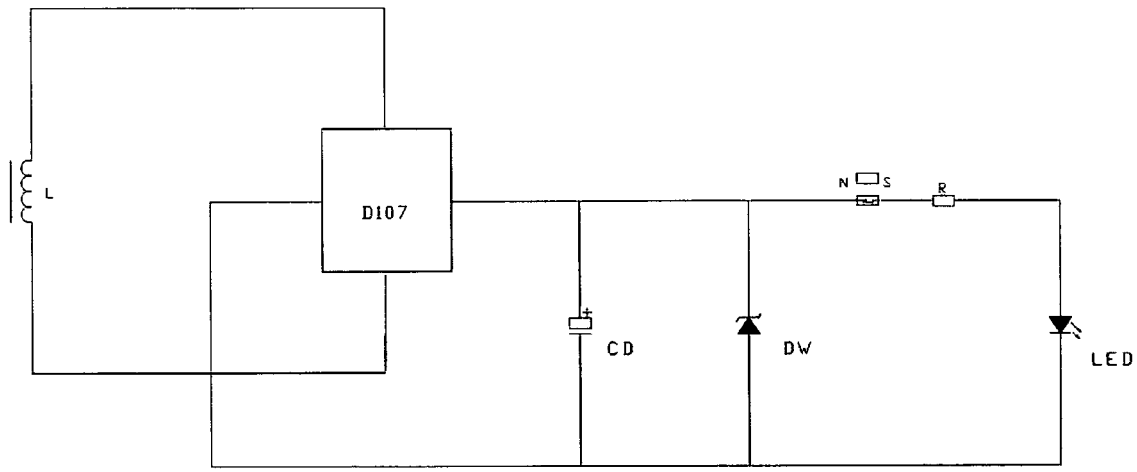
FIG. 2 is a side cross sectional view of another preferred embodiment of the invention.

The interconnecting circuit comprises a circuit board capacitor 6 associated with a light emitting diode 4 as shown in FIG. 2 to convert the copper coil 12 energization into an electrical charge with a four stage bridge AC to DC flow control rectifier system such that energy stored in the capacitor to power the light emitting diode 4.

Figure 3:
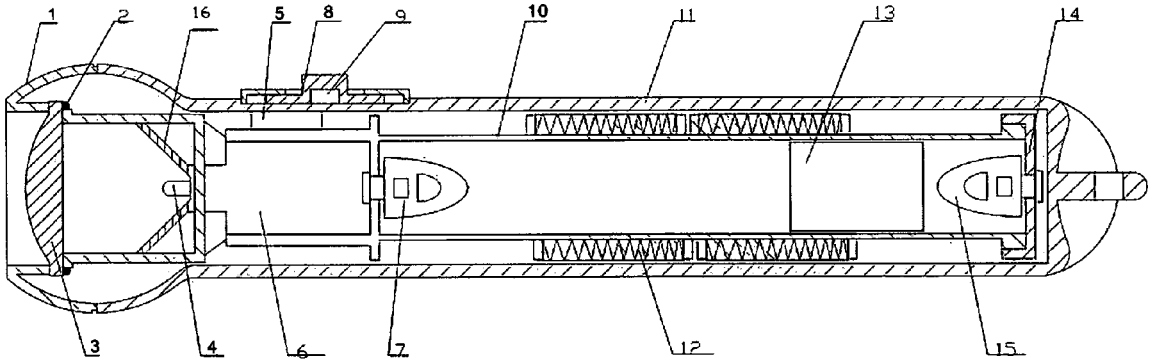
FIG. 3 is a single coil circuit schematic.
Figure 4:
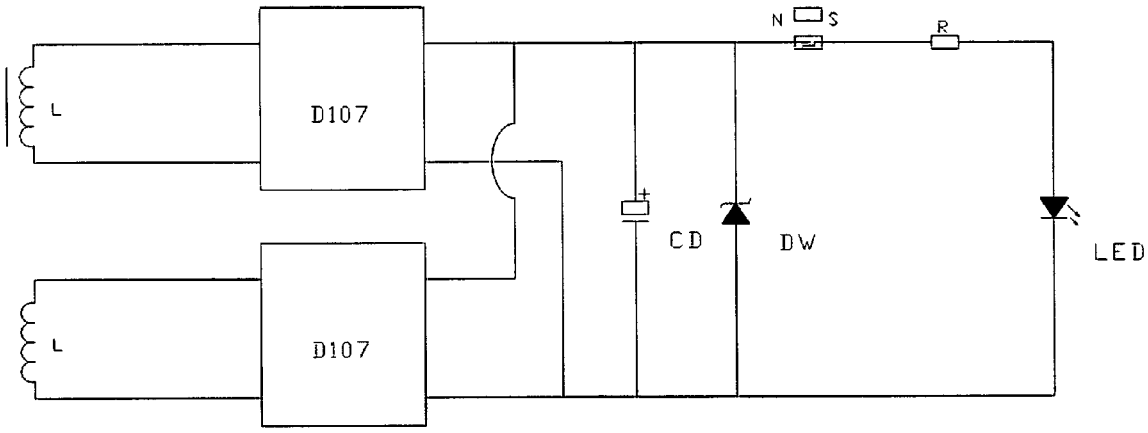
FIG. 4 is a dual coil schematic.

For faster charging, a second coil 12 is added to the embodiment of FIG. 1 as shown in FIG. 3. This dual coil 12 embodiment generates high frequency additional current for each transverse pass of the charging magnet 13. The charging circuit of the embodiment shown in FIG. 3 is shown in FIG. 4.

Figure 5:
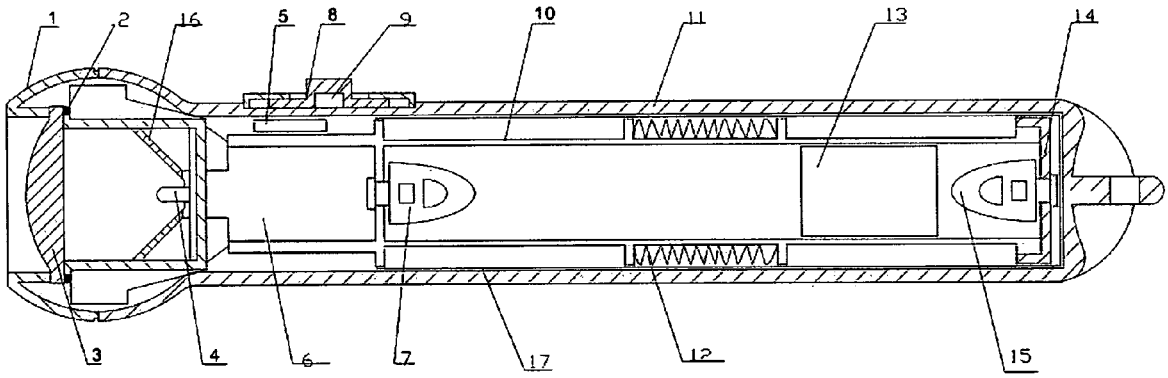
FIG. 5 is a cross section view of the housing with magnetic field suppression film.

In addition, this dual coil 12 embodiment employs a magnetic shielding lining 17 of the interior of the housing 11 to prevent interference with electronic components or other devices coming within the immediate proximity of the renewable energy flashlight as shown in FIG. 5.

Figure 6:
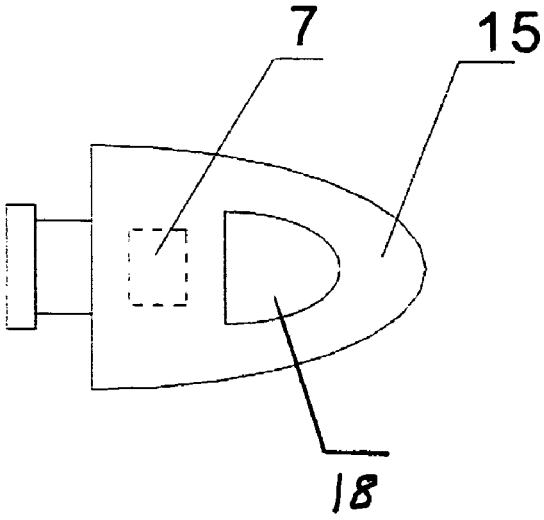
FIG. 6 a cross section view of the elastomagnetic rebound member.
Figure 7:
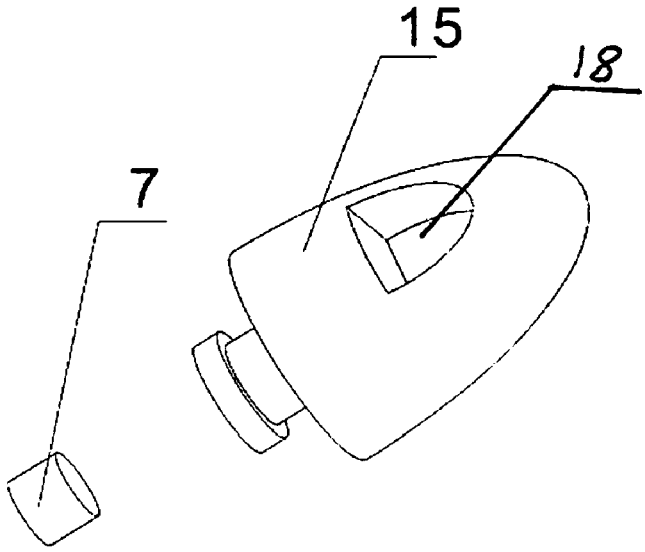
FIG. 7 is a perspective view of the elastomagnetic rebound member of FIG. 6.

FIG. 6 a perspective view of the elastomagnetic rebound member 15 showing the embedded seed magnet 7 and the surrounding elastic resilient material which prevents magnet to magnet contact while providing dual electro and elastic recoil action. A hole 18 is inserted within the elastic resilient material proximate the magnet 7 to reduce its weight and assist in resilient rebound action. FIG. 7 is a perspective view of the elastomagnetic rebound member 15 of FIG. 6.

The invention thus provides a renewable energy flashlight employing a pair of elastomagnetic repulsion members 15 to assist in reciprocating a charging magnet 7 passing through surrounding induction coils 12 to enhance the efficiency of manually charging a capacitor 6 to power an LED 4 lens 3 amplified flashlight.

The above description and specification should not be construed as limiting the scope of the claims. The claims themselves contain those features deemed essential to the invention.

We claim:

1. A renewable energy flashlight comprising:

a. a main housing with an opening at one end leading into an interior chamber and a closed end, b. a cylindrical tubular carriage sized to fit and be inserted within the main housing interior chamber, said carriage defining an internal transverse chamber with a first end, and a second end, c. support structure associated with the main housing and/or tubular carriage for holding electrical components proximate the opening of the main housing, d. a charging magnet having a magnetic field mounted within the internal transverse chamber structured to hold the charging magnet for lateral transversing movement between the first end and second end of the carriage unit, e. a pair of elastomagnetic repulsion members, each elastomagnetic repulsion member comprised of an elastic rebounding material reflexively seeded with at least one internal magnet, one of the elastomagnetic repulsion members mounted to the first end of the carriage unit in polar opposition to the charging magnet and the other mounted to the second end of the carriage unit in polar opposition to the charging magnet, wherein the rebound material of the elastomagnetic repulsion member is first compressed until the charging magnet is slowed in the proximity of the at least one seeded internal magnet, the charging magnet is then rebounded both elastically and magnetically between the elastomagnetic repulsion members, f. at least one induction coil wrapped around the tubular carriage such that the charging magnet may pass completely through the induction coil during each transverse pass to induce current through the induction coil, g. a capacitor operably associated with the induction coil for storage of electric current generated by the induction coil, h. a light emitting diode mounted on the structure, i. a convex magnifying lens covering and ceiling the opening of the housing, and j. circuitry mounted on the support structure and connected to the capacitor, the light emitting diode and the induction coil to selectively charge the capacitor in one mode and discharge the capacitor to power the diode in the other mode.

2. A renewable energy flashlight according to claim 1, including shielding surrounding the tubular carriage.

3. A renewable energy flashlight according to claim 2, wherein the shielding comprises a housing constructed of a magnetically impervious material.

4. A renewable energy flashlight according to claim 2, wherein the shielding comprises a conductive coating applied to the interior of the housing surrounding the tubular carriage.

5. A renewable energy flashlight according to claim 1, including a concave reflective mirror surrounding the light emitting diode structured to capture and direct light through the lens.

6. A renewable energy flashlight according to claim 1, wherein the components are sealed within the housing forming a water impervious flashlight.

7. A renewable energy flashlight according to claim 5, wherein the circuitry includes a reed switch mounted to the exterior of the housing.

8. A renewable energy flashlight according to claim 5, wherein the flashlight has a density less than water.

9. A renewable energy flashlight according to claim 1, wherein the elastomagnetic repulsion members are constructed of silicone.

* * * * *